United States Patent [19]

Jarvis

[11] Patent Number: 4,938,377

[45] Date of Patent: Jul. 3, 1990

[54] DEVICE FOR PRESERVING AROMA AND FLAVOR OF POTABLE LIQUID INCLUDING A BUOYANT LID

[76] Inventor: Robert B. Jarvis, 1801 N. 29th St., Boise, Id. 83703

[21] Appl. No.: 430,255

[22] Filed: Nov. 2, 1989

[51] Int. Cl.[5] ..... B65D 25/10

[52] U.S. Cl. ..... 220/216; 220/93; 220/90.4; 222/386

[58] Field of Search ..... 220/93, 216, 90.4; 215/317; 222/475.1, 386, 465.1

[56] References Cited

U.S. PATENT DOCUMENTS

| | | | |
|---|---|---|---|
| 203,180 | 4/1878 | Miller | 220/216 |
| 241,888 | 5/1881 | Smout | 220/216 |
| 446,254 | 2/1891 | Forrester | 220/216 |
| 509,917 | 12/1893 | Lewis | 220/216 |
| 662,782 | 11/1900 | Fisher | 220/216 |
| 1,990,918 | 2/1935 | Ramsden | 220/216 |
| 2,227,172 | 12/1940 | Bainton | 220/93 |
| 2,820,580 | 1/1958 | Figge | 222/509 |
| 3,256,977 | 6/1966 | Petterson | 220/216 |
| 3,578,467 | 5/1971 | Huber | 99/182 |
| 3,719,306 | 3/1973 | Holtzman | 220/93 |
| 3,987,941 | 10/1976 | Blessing | 222/386 |
| 4,361,249 | 11/1982 | Tuneski | 220/254 |
| 4,363,262 | 12/1982 | Pinckley et al. | 222/475.1 |
| 4,646,919 | 3/1987 | Iradjpanah | 220/93 |
| 4,682,705 | 7/1987 | Hurwitz | 220/93 |
| 4,733,792 | 3/1988 | Wasserman | 220/216 |

*Primary Examiner*—Stephen Marcus
*Assistant Examiner*—S. Castellano
*Attorney, Agent, or Firm*—Paul F. Horton

[57] ABSTRACT

A device for preserving aroma and fresh flavor of potable liquids and of coffee, in particular. The device comprises a vessel for holding the coffee; a buoyant lid receivable within the vessel for floating upon the coffee; and a lid retainer, with pouring apertures, which snaps on to the vessel for retention of the lid during the pouring procedure. The vessel and lid are preferably constructed of thermally insulative material for heat retention.

2 Claims, 1 Drawing Sheet

DEVICE FOR PRESERVING AROMA AND FLAVOR OF POTABLE LIQUID INCLUDING A BUOYANT LID

BACKGROUND OF THE INVENTION

1. Field of the Invention

This invention relates to devices which preserve the aroma and flavor of potable liquids and, more particularly, to vessels with buoyant lids for preserving the aroma and fresh taste of coffee.

2. Description of the Prior Art

True aficionados of coffee are well aware that the delectable brew keeps its aroma and flavor much better when not reheated and when not exposed to the air. Vacuum bottles are ideal for preserving the flavor and aroma, but are impractical for general household use.

In attempting to overcome these problems, several devices have been invented, as typified by U.S. Pat. No. 1,990,918, issued to B. Ramsden and U.S. Pat. No. 4,733,792, issued to G. S. Wasserman et al. Ramsden discloses a float which protects the liquid from substantial contact with the air and Wasserman discloses a floating lid with an aperture to permit beverage flow therethrough Other relevant devices are those disclosed by A. Tellier, U.S. Pat. No. 2,529,114; B. Selten, U.S. Pat. No. 2,358,600 and G. Ross, U.S. Pat. No. 4,582,218. A problem with all floating lid devices is that of providing sufficient clearance between the inner wall of the vessel and the outer edge of the floating lid so that the lid will, at all times, float on and adjust to the level of the liquid, while, at the same time, allowing for unobstructed flow of the liquid without loss or discharge of the lid during the pouring process.

SUMMARY OF THE INVENTION

The device of the present invention overcomes this problem by providing a vessel with floating lid and with a lid retainer which defines a plurality of pour apertures in its engagement with the vessel and which conveniently snaps on and off the vessel. Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
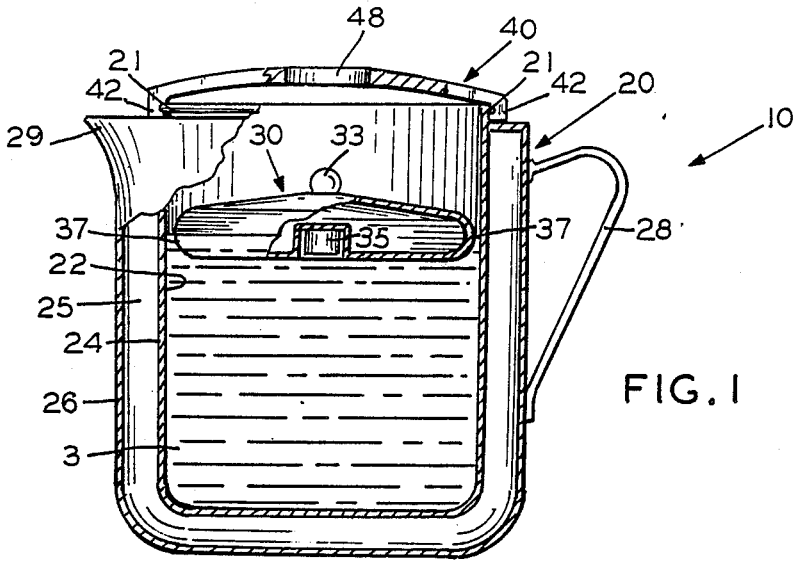
FIG. 1 is a side elevation, in partial section, of one embodiment of the device of the present invention.
Figure 2:
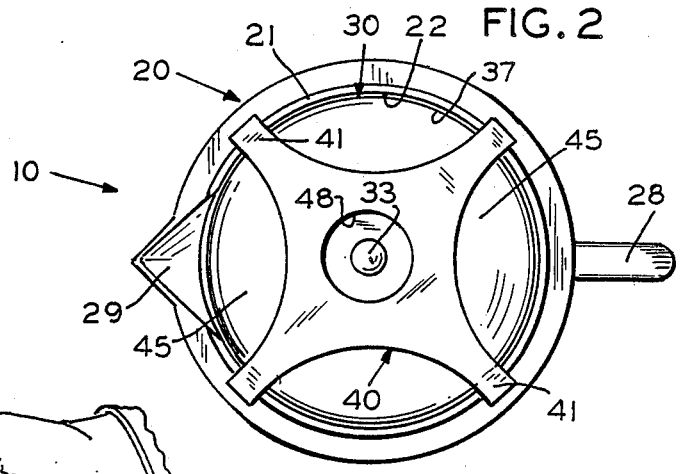
FIG. 2 is a plan view of the device shown in FIG. 1.
Figure 3:
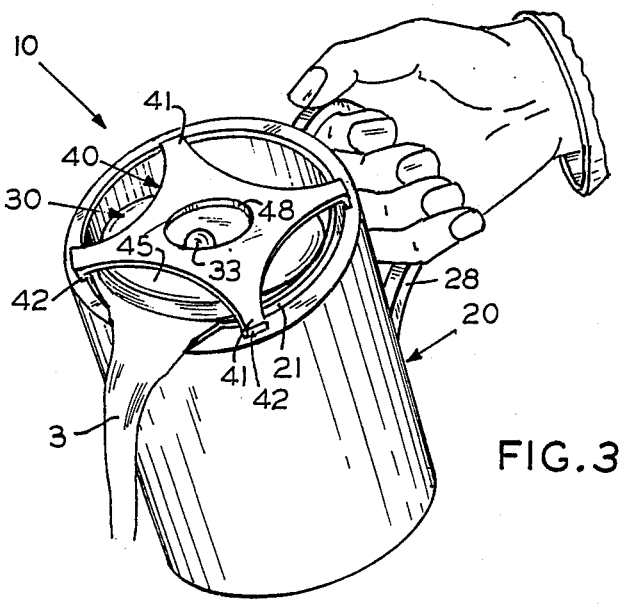
FIG. 3 is a perspective view showing retention of the lid during the pouring process.

Referring now to the drawings, an embodiment to be preferred of a device 10 for preserving the aroma and flavor of potable liquids, made according to the present invention, is disclosed. Device 10 includes, generally, a vessel 20; a buoyant lid 30; and a lid retainer 40.

Vessel 20, for receiving potable liquids, is preferably circular in cross section and includes an inner shell 24 and an outer shell 26 separated by a thermally insulative barrier 25 such as polyurethane, an air chamber, a vacuum chamber, or the like, to maintain the temperature of the liquid 3. A pour spout 29 and handle 28 may be provided for convenience in pouring. It is also desirable that the upper rim be provided with an outwardly extending lip 21 for engagement by retainer 40, as will hereinafter be explained. It is important that inner wall 22 of inner shell 24 be uniform in diameter for unobstructed floatation of lid 30.

Receivable within vessel 20 is buoyant lid 30. The buoyancy of the lid enables the lid to cover the liquid and remain level with the liquid within the vessel, even while pouring. The lid is also circular in cross section and is of a diameter only slightly smaller than the constant diameter of inner wall 22 of the vessel so as to substantially cover the entire surface of the liquid and yet be unobstructed in its vertical movement as determined by the amount of liquid within the vessel. Lid 30 is preferably made of insulative, heat resistant, material such as glass, ceramic, or any number of conventional plastics suitable for such purpose. Insulative plastic, encapsulated air, or a vacuum chamber may serve as an insulator. Lid 30 is provided with a central knob 33, on its upper surface, for placement and removal of the lid within the vessel and may be provided with a weight 35 to lower the center of gravity of the lid for maintaining the level of the lid as it floats upon the liquid. To prevent binding between inner walls 22 of the vessel and the lid, the sides 37 of the lid are convexly curved.

Lid retainer 40 includes one or more pair of opposing arms 41 provided at their terminal ends with flexible clamp members 42 for snapping the lid onto and in fixed engagement with vessel 20. Members 42 fit over and are retained by lip 21 of the vessel. Arms 41 of lid retainer 40 define a plurality of apertures 45 in their engagement with the vessel for unobstructed pouring of the liquid; the arms retaining the lid. At its center, retainer 40 defines an opening 48 which permits elevation of knob 33 through the opening when the vessel is full and through which the knob may be grasped, if desired. The retainer may be constructed of flexible metal or plastic.

In use, and assuming freshly brewed coffee as the potable liquid, with lid and lid retainer removed, vessel 20 may receive the coffee in the same manner as a conventional drip type coffee maker receptacle. Lid 30 is then placed within the vessel so as to float on the coffee and lid retainer 40 is then snapped onto the vessel with clamp members 42 engaging the lip 21 of the vessel. With the lid in place, the coffee can be stored for long periods without appreciable loss of taste and aroma and, because of the thermally insulative lid and vessel, the coffee will retain its warmth for long periods of time, without reheating. To obtain coffee from the vessel, handle 28 may be grasped and the liquid poured in conventional manner. The lid, which might otherwise be discharged with the coffee, engages arms 41 of the retainer so as to remain in its liquid-level position. While coffee has been described as the preferred potable liquid, it is obvious that this device is well suited for both heated and cooled liquids.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the mean-ing and range of equivalency of the claims are therefore to be embraced therein.

I claim:

1. A device for preserving aroma and flavor of potable liquids including:

a vessel;

a buoyant lid receivable within said vessel; and a lid retainer, separable from said vessel and defining at least one pour aperture, and said lid retainer including a plurality of flexible members operable to snap on to said vessel for holding said retainer in place.

2. A device for preserving aroma and flavor of potable liquids including:

a vessel used for pouring, circular in cross section, and having a thermally insulative barrier;

a buoyant lid, circular in cross section, and having a diameter slightly less than the inside diameter of said vessel for closely engaging said vessel; said lid being constructed of thermally insulative material and provided with curved side walls to prevent binding between said lid with said vessel; and a lid retainer operable to hold said lid within said vessel during the pouring process; said retainer defining at least one pour aperture in its engagement with said vessel; and said retainer provided with a plurality of flexible clamp members for snapping said retainer into fixed engagement with said vessel.

* * * * *